US008224224B2

(12) United States Patent
Ohmori et al.

(10) Patent No.: US 8,224,224 B2
(45) Date of Patent: Jul. 17, 2012

(54) CLEANING BLADE AND IMAGE FORMING APPARATUS, PROCESS CARTRIDGE, AND IMAGE FORMING METHOD USING THE SAME

(75) Inventors: Masahiro Ohmori, Yokohama (JP); Yohta Sakon, Isehara (JP); Yasuyuki Yamashita, Zama (JP); Masanobu Gondoh, Ebina (JP); Sayaka Katoh, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 512 days.

(21) Appl. No.: 12/483,763

(22) Filed: Jun. 12, 2009

(65) Prior Publication Data

US 2009/0311017 A1 Dec. 17, 2009

(30) Foreign Application Priority Data

Jun. 13, 2008 (JP) ..... 2008-155454
Nov. 28, 2008 (JP) ..... 2008-304279
Mar. 13, 2009 (JP) ..... 2009-061887

(51) Int. Cl.
*G03G 21/00* (2006.01)

(52) U.S. Cl. ..... 399/350; 399/343; 399/351

(58) Field of Classification Search ..... 399/343, 399/350, 351
See application file for complete search history.

(56) References Cited

U.S. PATENT DOCUMENTS 5,995,785 A * 11/1999 Kato et al. ..... 399/127
6,704,539 B2 * 3/2004 Nakayama ..... 399/350
7,254,364 B2 * 8/2007 Nakayama ..... 399/345
7,796,934 B2 * 9/2010 Teshigawara ..... 399/350
7,907,884 B2 * 3/2011 Morita ..... 399/350
2006/0216526 A1 * 9/2006 Tomiyama et al. ..... 428/423.1

FOREIGN PATENT DOCUMENTS

JP 06035385 A * 2/1994
JP 08166752 A * 6/1996
JP 09-127846 5/1997
JP 2000066555 A * 3/2000
JP 2001265190 A * 9/2001
JP 2001343874 A * 12/2001
JP 2002311639 A * 10/2002
JP 2003-122213 4/2003
JP 2003-167491 6/2003
JP 2004-233818 8/2004
JP 2005-128311 5/2005
JP 2005156696 A * 6/2005
JP 2005181434 A * 7/2005
JP 2005208238 A * 8/2005
JP 2005-345758 12/2005
JP 2007047272 A * 2/2007

* cited by examiner

*Primary Examiner* — David Gray
*Assistant Examiner* — Fred L Braun
(74) *Attorney, Agent, or Firm* — Oblon, Spivak, McClelland, Maier & Neustadt, L.L.P.

(57) ABSTRACT

A cleaning blade for removing fine particles from a cleaning target by contact with the cleaning target, a method of using the cleaning blade, and an image forming apparatus and process cartridge using the cleaning blade. The cleaning blade includes an elastic blade. A leading edge of the elastic blade includes a friction coefficient of 0.5 or less. The cleaning blade also includes a surface layer that covers the leading edge of the elastic blade. A thickness of the surface layer is between 1 to 50 μm at a position 50 μm away from the leading edge, and a hardness of the surface layer is greater hardness than the elastic blade.

15 Claims, 4 Drawing Sheets

AREA: S
CIRCUMFERENTIAL LENGTH: C1

AREA: S
CIRCUMFERENTIAL LENGTH: C2

CLEANING BLADE AND IMAGE FORMING APPARATUS, PROCESS CARTRIDGE, AND IMAGE FORMING METHOD USING THE SAME

CROSS REFERENCE TO RELATED APPLICATIONS

This specification claims priority and contains subject matter related to Japanese Patent Applications Nos. 2008-155454 filed on Jun. 13, 2008, 2008-304279 filed on Nov. 28, 2008, and 2009-061887 filed on Mar. 13, 2009, the entire contents of each of which are incorporated herein by reference.

BACKGROUND OF THE INVENTION

1. Field of the Invention

Exemplary aspects of the present invention relate to a cleaning blade in image forming apparatuses such as printers, facsimiles, and copiers. The present invention also relates to an image forming apparatus, a process cartridge, and an image forming method using the cleaning blade.

2. Discussion of the Background

In electrophotography, a toner image may be formed on an image bearing member such as a photoreceptor and is subsequently transferred onto a transfer paper or an intermediate transfer member. Some toner particles may remain on a surface of the image bearing member without being transferred. Such residual toner particles are typically removed by a cleaning device.

Cleaning devices employing a rectangular-shape cleaning blade are widely used because of its simple configuration and cleaning ability. Such rectangular-shape cleaning blades are typically made of elastic bodies such as polyurethane rubbers. Typically, a base end of a cleaning blade is supported by a support member, and a leading edge is pressed against a circumferential surface of an image bearing member so that the cleaning blade banks up and scrapes off residual toner particles remaining on the image bearing member.

To improve image quality, small-size and spherical toners which can be manufactured by polymerization methods (such toners are hereinafter referred to as polymerization toners) can be used for image forming apparatuses. Advantageously, polymerization toners can be more effectively transferred from an image bearing member onto a transfer paper or an intermediate transfer member compared to pulverization toners. In other words, polymerization toners have higher transfer efficiency than pulverization toners. On the other hand, polymerization toners may be difficult to remove from a surface of an image bearing member by a cleaning blade because they may pass through a thin gap formed between the cleaning blade and the image bearing member because of their small size and spherical shape.

To prevent such passing through of toner particles, a cleaning blade is preferably pressed against an image bearing member with high pressure. However, as illustrated in FIG. 1A, a leading edge 262*c* of a related art cleaning blade 262 tends to curl up towards an adjacent surface 262*b* because the cleaning blade 262 is stretched in a direction of movement of an image bearing member 23 due to a friction force between the image bearing member 23 and the cleaning blade 262. When the cleaning blade 262 returns to its original shape, noise may occur. If the cleaning blade 262 continues removing toner particles with the leading edge 262*c* curling up, a leading surface 262*a* may be partially abraded, as illustrated in FIG. 1B. Eventually the leading edge 262*c* may be removed, as illustrated in FIG. 1C. Therefore, the related art cleaning blade 262 makes it difficult to remove residual toner particles.

Japanese Patent No. 3602898, for example, discloses a cleaning blade made of a polyurethane elastomer in which a part (hereinafter "contact part") which is to be brought into contact with an image bearing member is covered with a surface layer containing a resin having a pencil hardness of from B to 6H. It is described therein that because such a surface layer is harder than rubber materials, the friction coefficient of the contact part is decreased, which results in an improvement of abrasion resistance of the cleaning blade. It is further described therein that the surface layer decreases a friction force between the image bearing member and the cleaning blade, which results in prevention of curling up of a leading edge of the cleaning blade. It is further described therein that the surface layer having a pencil hardness of from B to 6H is unlikely to deform, which also results in prevention of curling up of a leading edge of the cleaning blade.

Unexamined Japanese Patent Application Publication No. 2004-233818, for example, discloses a cleaning blade formed by the following method. First, an elastic blade is impregnated with an ultraviolet hardening material containing silicon and is subsequently exposed to an ultraviolet ray so that a hardened layer is formed on a surface of the blade. It is described therein that the hardened layer thus formed from the ultraviolet hardening material has a greater hardness than the elastic blade, and therefore abrasion resistance improves and curling up of a leading edge of the blade is prevented.

SUMMARY OF THE INVENTION

In an exemplary embodiment, a cleaning blade is configured to remove fine particles from a cleaning target by contact with the cleaning target. The cleaning blade includes an elastic blade. A leading edge of the elastic blade includes a friction coefficient of 0.5 or less. The cleaning blade also includes a surface layer that covers the leading edge of the elastic blade. A thickness of the surface layer is between 1 to 50 μm at a position 50 μm away from the leading edge. A hardness of the surface layer is greater than a hardness of the elastic blade.

In another exemplary embodiment, an image forming method includes forming a toner image on an image bearing member, transferring the toner image from the image bearing member onto a transfer member, and removing toner particles that remain on the transfer member using a cleaning blade. The cleaning blade includes an elastic blade, a leading edge of the elastic blade including a friction coefficient of 0.5 or less. The cleaning blade also includes a surface layer that covers the leading edge of the elastic blade, which has a thickness of from 1 to 50 μm at a position 50 μm away from the leading edge. A hardness of the surface layer is greater than a hardness of the elastic blade.

In another exemplary embodiment, a cleaning blade is configured to remove fine particles from a cleaning target by contact with the cleaning target. The cleaning blade includes an elastic blade. A leading edge of the elastic blade includes a friction coefficient of 0.5 or less. The cleaning blade also includes a means for covering the leading edge of the elastic blade. A thickness of the means for covering is between 1 to 50 μm at a position 50 μm away from the leading edge. A hardness of the means for covering is greater than a hardness of the elastic blade.

BRIEF DESCRIPTION OF THE DRAWINGS

A more complete appreciation of the disclosure and the aspects, features and advantages thereof will become apparent upon consideration of the following description of the preferred embodiments of the present invention taken in conjunction with the accompanying drawings, wherein.

DETAILED DESCRIPTION OF THE INVENTION

Figure 1A:
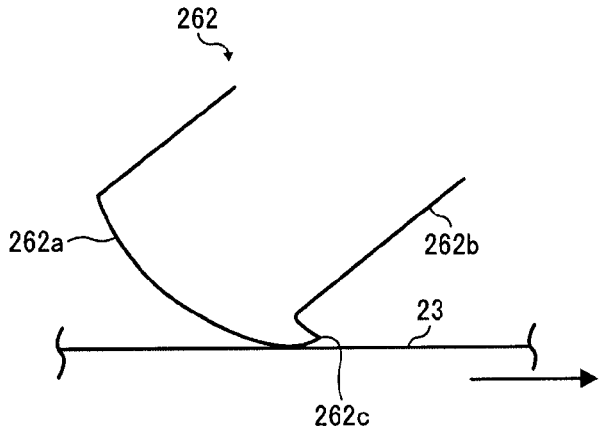
FIG. 1A RELATED ART
FIGS. 1A to 1C are schematic views of an example of deterioration of a related-art cleaning blade.

As described above, surface layers of a cleaning blade may be abraded with time. As a result, leading edges of elastic blades may be exposed and may directly contact an image bearing member. Since a leading edge of an elastic blade typically has a large friction coefficient, a friction force between the exposed portion of the elastic blade and the image bearing member is large. As a result, the exposed portion of the elastic blade is stretched and deforms in a direction of movement of the image bearing member. Because the exposed portion has a very small area, the degree of deformation of the exposed portion is very small as well. In other words, the exposed portion deforms slightly. The exposed portion repeatedly deforms slightly toward a direction of movement of the image bearing member, followed by returning to its original state. This movement is hereinafter referred to as "micro-vibration". The micro-vibration may disadvantageously cause noise. In some cases, the exposed portion may be chipped away, resulting in insufficient cleaning of an image bearing member.

Accordingly, an exemplary embodiment of the present invention provides a cleaning blade which cleans a cleaning target without making noise.

The exemplary embodiment may be provided to an image forming apparatus, a process cartridge, and an image forming method which may reliably and constantly produces high grade images.

In describing exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

A first example embodiment of the present invention is described below.

Figure 2:
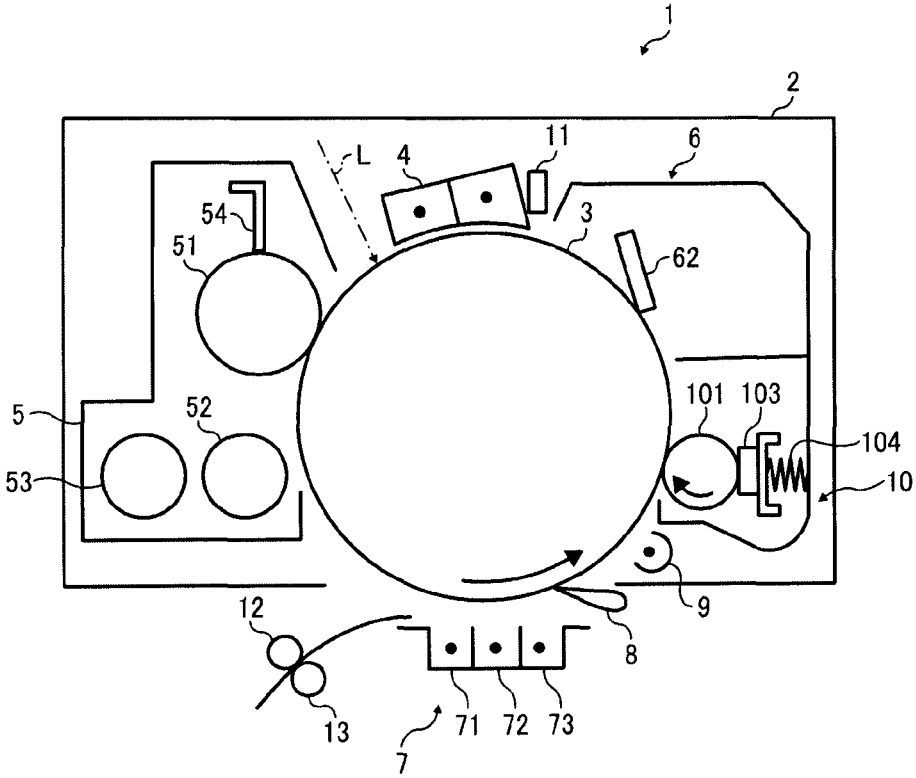
FIG. 2 is a schematic view illustrating an embodiment of an image forming apparatus, which, for example, is an electrophotographic printer.

FIG. 2 is a schematic view illustrating an exemplary embodiment of an image forming apparatus, which is an electrophotographic printer (hereinafter simply referred to as a printer). The printer illustrated in FIG. 2 forms a monochrome image based on image data read by an image reader, not shown.

The printer contains a photoreceptor 3 serving as an image bearing member. Although having a drum shape in FIG. 2, the photoreceptor 3 may have a sheet shape or an endless belt shape.

Around the photoreceptor 3, a charger 4 is configured to charge the photoreceptor 3, and a developing device 5 is configured to develop a latent image with a toner to form a toner image. A transfer device 7 is configured to transfer the toner image onto a transfer paper serving as a recording medium. A separation pick 8 is configured to separate the transfer paper from the photoreceptor 3. A pre-cleaning charger 9 is configured to control charge polarity of residual toner particles remaining on the photoreceptor 3, and a cleaning device 6 is configured to remove the residual toner particles from the photoreceptor 3. A lubricant applicator 10 is provided, and a neutralization lamp 11 is configured to neutralize the photoreceptor 3.

The charger 4 is disposed forming a predetermined gap between the photoreceptor 3 and is configured to charge the photoreceptor 3 to a predetermined potential with a predetermined polarity, for example. After being evenly charged by the charger 4, the photoreceptor 3 is irradiated with a light beam L emitted from an irradiator serving as a latent image forming device, not shown, based on image data so that an electrostatic latent image is formed thereon.

The developing device 5 contains a developing roller 51 serving as a developer bearing member to which a developing bias is applied from an electric source, not shown. The developing device 5 further contains a supply screw 52 and an agitation screw 53 configured to feed and agitate a developer by rotating in different directions; and a doctor 54 configured to control the thickness of the developer born on the developing roller 51. A toner in the developer which is agitated and fed by the supply screw 52 and the agitation screw 53 is charged to a predetermined polarity. The developer is drawn up on the developing roller 51 and the thickness thereof is controlled by the doctor 54. The toner in the developer adheres to the electrostatic latent image formed on the photoreceptor 3 at an area where the developing roller 51 faces the photoreceptor 3, so that a toner image is formed on the photoreceptor 3.

The transfer device 7 contains a pre-transfer charger 71, a transfer charger 72, and a separation charger 73. The pre-transfer charger 71 controls the polarity of the toner image by negative corona discharge, the transfer charger 72 transfers the toner image onto a transfer paper by corona discharge, and the separation charger 73 separates the transfer paper from the photoreceptor 3 by corona discharge and the separation pick 8.

The lubricant applicator 10 includes an application brush 101, a solid lubricant 103, and a lubricant pressing spring 104. The solid lubricant 103 is supported by a bracket, not shown, and is pressed against the application brush 101 by the lubricant pressing spring 104. The application brush 101 rotates so as to follow a direction of rotation of the photoreceptor 3 so that the solid lubricant 103 is abraded and applied to the photoreceptor 3. The lubricant applied to the photoreceptor 3 decreases a friction coefficient between the photoreceptor 3 and a cleaning blade 62.

The application brush 101 disturbs residual toner particles on the photoreceptor 3 and adheres them so some of the residual toner particles are removed from the photoreceptor 3.

The cleaning device 6 also contains the cleaning blade 62. The cleaning blade 62 is in contact with the photoreceptor 3 so as to counter a direction of movement of the surface of the photoreceptor 3. The cleaning blade 62 removes the residual toner particles still remaining on the photoreceptor 3 which have been disturbed by the application brush 101.

The pre-transfer charger 71, the separation pick 8, and the pre-cleaning charger 9 may be optionally provided according to need.

The charger 4, the pre-transfer charger 71, the transfer charger 72, the separation charger 73, and the pre-cleaning charger 9, may be corotron chargers, scorotron chargers, or solid state chargers for example.

In particular, chargers employing contact charging methods and non-contact adjacent charging methods are preferable because they have high charging efficiency, produce less ozone, and contribute to downsizing.

The irradiator, not shown, and the neutralization lamp 11, may be fluorescent lamps, tungsten lamps, halogen lamps, mercury lamps, sodium lamps, light emitting diodes (LED), laser diodes (LD), and electro luminescence (EL) for example.

In order to emit light with advantageous wavelengths, these light sources may be used in combination with filters such as sharp cut filters, band pass filters, near-infrared cut filters, dichroic filters, interference filters, and color temperature conversion filters, for example.

Among the above-described light sources, light emitting diodes (LED) and laser diodes (LD) are preferable because they have high irradiation energy and emit light having long wavelengths of from 600 to 800 nm.

Next, an exemplary image forming operation of the printer is described.

Upon reception of a signal to execute printing from an operation part, not shown, a predetermined voltage or current is sequentially applied to each of the charger 4, the developing roller 51, the pre-transfer charger 71, the transfer charger 72, the separation charger 73, and the pre-cleaning charger 9 at a predetermined timing. Similarly, a predetermined voltage or current is sequentially applied to each of the irradiator and the neutralization lamp 11 at a predetermined timing. In synchronization with the above-described operation, the photoreceptor 3 is driven to rotate counterclockwise as shown in FIG. 2 by a driving motor, not shown.

After the photoreceptor 3 starts rotating counterclockwise, a surface of the photoreceptor 3 is charged to a predetermined potential by the charger 4. The irradiator, not shown, emits a light beam L corresponding to an image signal onto the photoreceptor 3. An area on the photoreceptor 3 to which the light beam L is directed is neutralized, resulting in formation of an electrostatic latent image.

The photoreceptor 3 having the electrostatic latent image thereon is abrasively contacted by magnetic brushes of a developer formed on the developing roller 51 at an area where the photoreceptor 3 faces the developing device 5. Negative toner particles on the developing roller 51 migrate to the electrostatic latent image due to a developing bias applied to the developing roller 51, resulting in formation of a toner image on the photoreceptor 3. Accordingly, in the present embodiment, an electrostatic latent image formed on the photoreceptor 3 is developed with negative toner particles by the developing device 5. This developing process is called "reverse developing process". More specifically, such a process in which toner particles adhere to areas having lower potentials is called "N/P (negative/positive) developing process". The present embodiment employs a non-contact charging roller for charging the photoreceptor 3, however, preferable methods of charging the photoreceptor 3 are not limited thereto.

The toner image is then transferred from the photoreceptor 3 onto a transfer paper at a transfer area formed between the photoreceptor 3 and the transfer charger 72. The transfer paper is fed from a paper feed part, not shown, through between an upper registration roller 12 and a lower registration roller 13 in synchronization with an entry of a leading edge of the toner image in the transfer area. At the time of transferring of the toner image, a predetermined transfer bias is applied to the transfer paper. The transfer paper having the toner image thereon is then separated from the photoreceptor 3 by cooperation of the separation pick 8 and the separation charger 73, and is fed to a fixing device, not shown. The toner image is fixed on the transfer paper by application of heat and pressure in the fixing device. Finally, the transfer paper on which the toner image is fixed is discharged from the printer.

On the other hand, the lubricant applicator 10 applies a lubricant to the photoreceptor 3. Residual toner particles remaining on the photoreceptor 3 without being transferred onto the transfer paper are removed by the cleaning device 6, and the photoreceptor 3 is neutralized by the neutralization lamp 11.

As illustrated in FIG. 2, the photoreceptor 3, the charger 4, the developing device 5, the cleaning device 6, and the lubricant applicator 10 are contained in a casing 2 to form a process cartridge 1. The process cartridge 1 is detachably provided to printers. In the present embodiment, the process cartridge 1 has a configuration such that the photoreceptor 3, the charger 4, the developing device 5, the cleaning device 6, and the lubricant applicator 10 are integrally replaced. Alternatively, the process cartridge 1 may have a configuration such that each of the photoreceptor 3, the charger 4, the developing device 5, the cleaning device 6, and the lubricant applicator 10 is separately replaced.

The printer preferably uses spherical and small-size toners which may be manufactured by polymerization methods such as suspension polymerization methods, emulsion aggregation polymerization methods, and dispersion polymerization methods, for example, for the purpose of improving image quality. Such toners are hereinafter referred to as polymerization toners.

In particular, a polymerization toner having an average circularity of 0.97 or more and a volume average particle diameter of 5.5 μm or less is preferable. Such a toner can produce high definition images.

The average circularity of a toner can be measured using, for example, a flow-type particle image analyzer FPIA-2000 from Sysmex Corp. A typical measurement method is as follows:

(1) 0.1 to 0.5 ml of a surfactant (preferably alkylbenzene sulfonate) is contained as a dispersant in 100 to 150 ml of water from which solid impurities have been removed, and 0.1 to 0.5 g of a toner is added thereto;

(2) the resultant suspension is dispersed using an ultrasonic dispersing machine for about 1 to 3 minutes and is controlled to contain 3,000 to 10,000 toner particles per 1 micro-liter of the suspension; and (3) the average circularity and circularity distribution of the toner are determined by the measuring instrument described above.

Figure 3A:
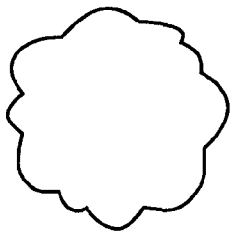
FIGS. 3A and 3B are schematic views illustrating the circularity of a particle.
Figure 3B:
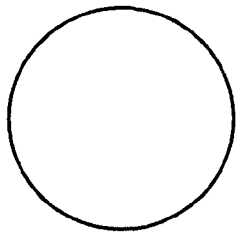

Specifically, the circularity of a particle is determined by the following equation:

$$\text{Circularity}=C2/C1$$

wherein C1 represents the circumferential length of a projected image of a particle having an area of S and C2 represents the circumferential length of a circle having the same area S as that of the projected image of the particle, as illustrated in FIGS. 3A and 3B. The average circularity is the average of circularities of multiple particles.

The volume average particle diameter of a toner can be measured using an instrument such as COULTER MULTISIZER 2e (from Beckman Coulter K. K.), for example. Specifically, the instrument measures number and/or volume distributions of toner particles and the measured data are sent to a personal computer through an interface (from Nikkaki-bios) so that the data is analyzed. A typical measuring method is as follows:

(1) 0.1 to 5 ml of a surfactant (preferably an alkylbenzene sulfonate) is contained as a dispersant in 100 to 150 ml of an electrolyte (i.e., 1% NaCl aqueous solution including a first grade sodium chloride);

(2) 2 to 20 mg of a toner is added to the electrolyte and dispersed using an ultrasonic dispersing machine for about 1 to 3 minutes to prepare a toner suspension liquid;

(3) another beaker is charged with 100 to 200 ml of the electrolyte and the toner suspension liquid prepared above is added thereto so that the resultant solution has a predetermined concentration; and (4) the solution is subjected to a measurement using COULTER MULTISIZER 2e, for example, using an aperture of 100 μm so that weight and number distributions of 50,000 particles of the toner are measured.

The channels include 13 channels as follows: from 2.00 to less than 2.52 μm; from 2.52 to less than 3.17 μm; from 3.17 to less than 4.00 μm; from 4.00 to less than 5.04 μm; from 5.04 to less than 6.35 μm; from 6.35 to less than 8.00 μm; from 8.00 to less than 10.08 μm; from 10.08 to less than 12.70 μm; from 12.70 to less than 16.00 μm; from 16.00 to less than 20.20 μm; from 20.20 to less than 25.40 μm; from 25.40 to less than 32.00 μm; and from 32.00 to less than 40.30 μm. Namely, particles having a particle diameter of from not less than 2.00 μm to less than 40.30 μm are measured.

The volume average particle diameter (Dv) can be measured by the following equation:

$$Dv=\Sigma XfV/\Sigma fV$$

wherein X represents a representative diameter in a channel, V represents a volume of a particle having the representative diameter in the channel, and f represent a number of particles in the channel.

Typically, polymerization toners are more difficult to remove from the photoreceptor 3 using the cleaning blade 62 compared to pulverization toners. In other words, removal efficiency of polymerization toners is lower than that of pulverization toners. One possible approach to improve removal efficiency of polymerization toners includes increasing a contact pressure of the cleaning blade 62 with the photoreceptor 3. However, this approach causes early wear of the cleaning blade 62. Further, since this approach increases a friction force between the cleaning blade 62 and the photoreceptor 3, a leading edge of the cleaning blade 62 which is in contact with the photoreceptor 3 is stretched in a direction of movement of the photoreceptor 3, resulting in curling up of the leading edge. Such a cleaning blade with a curled-up leading edge cannot remove toner particles normally, and therefore the resultant image may have an undesired band-shape toner image, for example.

In the present embodiment, the leading edge of the cleaning blade 62 is covered with a surface layer which is harder than a base elastic blade.

Figure 4:
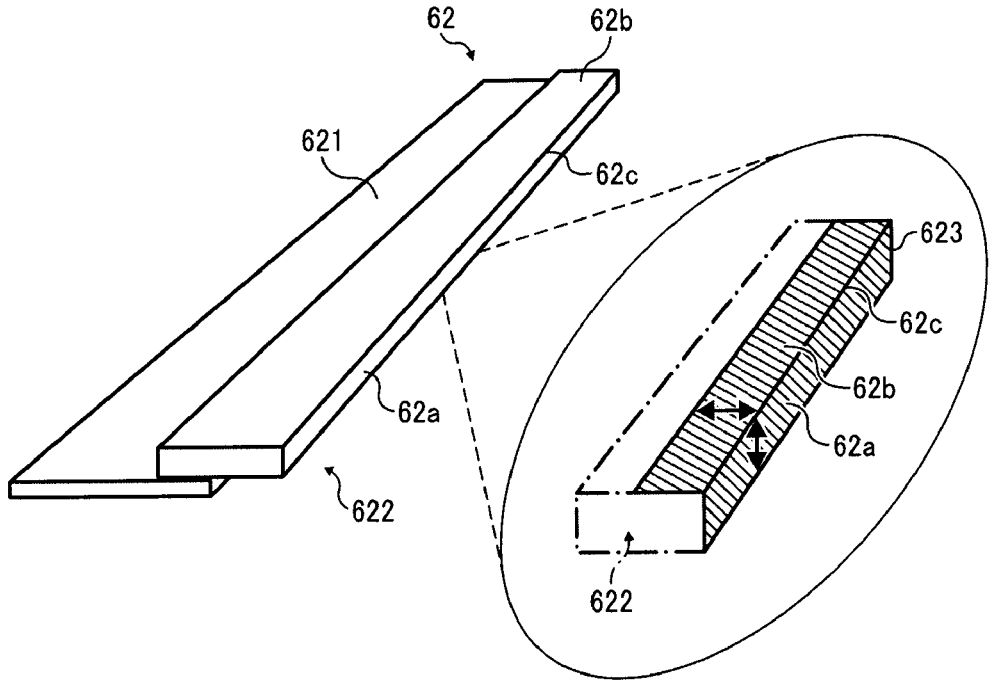
FIG. 4 is a perspective view illustrating an embodiment of a cleaning blade.
Figure 5:
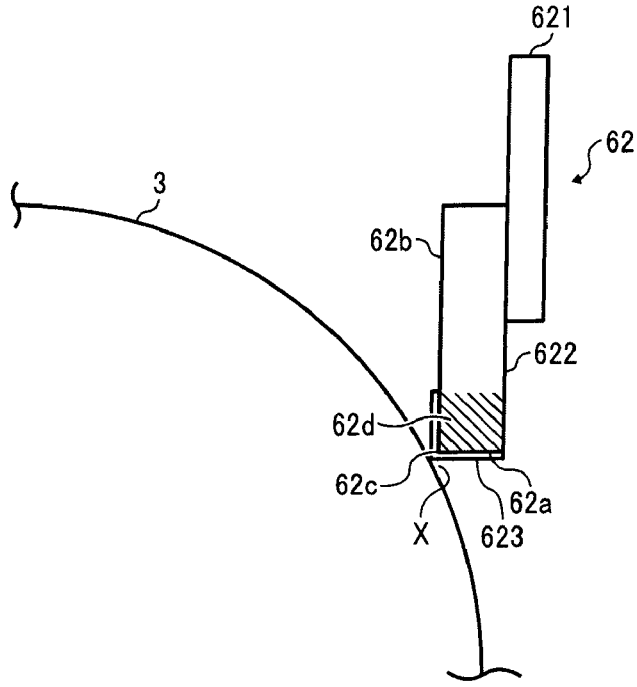
FIG. 5 is a lateral view illustrating an embodiment of the cleaning blade illustrated in FIG. 4.

FIG. 4 is a perspective view illustrating an exemplary embodiment of the cleaning blade 62. FIG. 5 is a lateral view illustrating an embodiment of the cleaning blade 62.

The cleaning blade 62 contains a rectangular-shape holder 621 made of a rigid material such as metal or hard plastic, for example. The exemplary cleaning blade 62 also has a rectangular-shape elastic blade 622, which includes a leading surface 62*a*, a leading edge 62*c*, and a part of a lower surface 62*b* adjacent to a leading edge 62*c*, each of which are covered with a surface layer 623.

The elastic blade 622 is fixed on one end of the holder 621 by an adhesive. The other end of the holder 621 is supported by a casing of the cleaning device 6.

Specific preferred examples of suitable materials for the elastic blade 622 include, but are not limited to, elastic bodies with high repellency such as rubbers having a urethane group. Such materials can follow eccentricity of the photoreceptor 3 and/or micro swellings on the surface of the photoreceptor 3. Specifically, urethane rubbers having a JIS-A hardness of from 65 to 80 degrees and a repulsive elastic modulus of from 15 to 80% at 25° C. are preferable. When the hardness is too large, flexibility may deteriorate. For example, in a case in which the holder 621 is attached to the elastic blade 622 having a high hardness with a slight inclination, both ends of the cleaning blade 62 in an axial direction may contact the photoreceptor 3 with different pressures. As a result, the photoreceptor 3 may not be cleaned sufficiently. By contrast, when the hardness is too small, the cleaning blade 62 may curl up particularly when the contact pressure with the photoreceptor 3 is set relatively high for the purpose of removing polymerization toners. Accordingly, the leading edge 62*c* may part from the photoreceptor 3 and the lower surface 62*b* may contact the photoreceptor 3, resulting in increase of the contact area and decrease of the contact pressure between the cleaning blade 62 and the photoreceptor 3. Consequently, the photoreceptor 3 may not be cleaned sufficiently.

Urethane rubbers having a repulsive elastic modulus of 80% or more are rarely commercially available. Therefore, the use of them may result in cost increase. When the repulsive elastic modulus is too large, the cleaning blade 62 may curl up and may not sufficiently clean the photoreceptor 3. As a result, the resultant image may have undesired band-shape toner images, for example. By comparison, when the repulsive elastic modulus is too small, such materials may not follow eccentricity of the photoreceptor 3 and/or micro swellings on the surface of the photoreceptor 3. As a result, the photoreceptor 3 may not be cleaned sufficiently.

Accordingly, urethane rubbers having a JIS-A hardness of from 65 to 80 degrees and a repulsive elastic modulus of from 15 to 80% at 25° C. are preferable for the cleaning blade 62.

The surface layer 623 that covers the leading edge 62*c* of the cleaning blade 62 may be advantageously formed by spray coating or dip coating. The surface layer 623 preferably has a hardness greater than the elastic blade 622, so as not to be abraded by the photoreceptor 3. The comparatively rigid surface layer 623 is less likely to deform and the leading edge 62*c* of the cleaning blade 62 is less likely to curl up.

The surface layer 623 preferably contains resins, more preferably ultraviolet hardening resins. Ultraviolet hardening resins can easily form the surface layer 623 in a simple process of being exposed to ultraviolet rays, which result in low manufacturing costs.

Figure 1B:
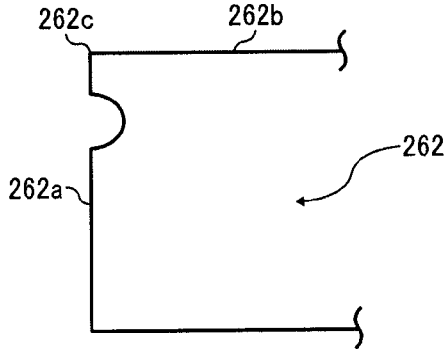
FIG. 1B RELATED ART
Figure 1C:
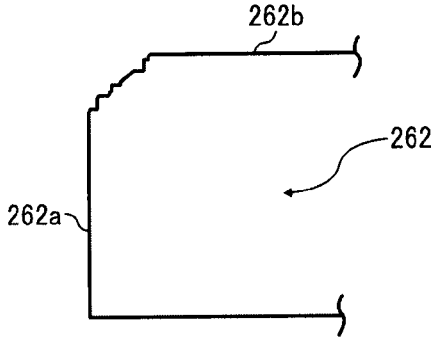
FIG. 1C RELATED ART

Suitable ultraviolet hardening resins are preferably formed from a monomer having a molecular weight of from 300 to 1,500 per functional group. When the molecular weight of the monomer is too large, the resultant surface layer 623 may be so brittle that the leading edge 62*c* may curl up and be abraded as illustrated in FIG. 1B. As a result, the cleaning blade 62 may not sufficiently clean the photoreceptor 3. When the molecular weight of the monomer is too small, the surface layer 623 may be so rigid that abrasion resistance may deteriorate and noise may occur. With regard to a typical cleaning blade made of rubber materials, the leading edge thereof is repeatedly stretched and deformed in a direction of movement of a photoreceptor, followed by returning to its original state. When the leading edge returns to its original state, noise is made. On the other hand, with regard to a cleaning blade having a large stiffness, the leading edge is deformed only slightly even when being stretched in a direction of movement of the photoreceptor. As a result, the leading edge vibrates slightly and makes noise as well.

The leading edge of such a cleaning blade having a large stiffness may be in abrasive contact with the photoreceptor constantly without being deformed and moved in a direction of movement of the photoreceptor. Therefore, such a cleaning blade is more likely to be abraded. Accordingly, it is apparent that to deform a cleaning blade in a direction of movement of a photoreceptor to some extent is effective for improving abrasion resistance of a cleaning blade because the leading edge is prevented from being brought into abrasive contact with the photoreceptor.

Further, such a cleaning blade having a large stiffness may not follow eccentricity of a photoreceptor very well, resulting in insufficient cleaning of the photoreceptor.

A surface layer containing an ultraviolet hardening resin formed from a monomer having a molecular weight of from 300 to 1,500 per functional group has a hardness that allows the leading edge of a cleaning blade to deform in a direction of movement of a photoreceptor without curling up. In this case, noise may not occur, the cleaning blade may have good abrasion resistance, the leading surface of the cleaning blade may not be abraded, and the cleaning blade may follow eccentricity of a photoreceptor.

Advantageously, multiple ultraviolet hardening resins can be mixed so that the mixture ultraviolet hardening resin has a molecular weight of from 300 to 1,500 per functional group.

In order to reduce a friction coefficient between the photoreceptor 3 and the cleaning blade 62, friction-coefficient-lowering components such as fluorocarbon resins and silicone resins may be advantageously mixed with ultraviolet hardening resins. In order to improve adhesiveness to the elastic blade 622, isocyanate compounds may also be mixed with ultraviolet hardening resins.

The surface layer 623 is formed covering the leading surface 62*a* and the lower surface 62*b*, and is preferably extending at least 50 μm away from the leading edge 62*c*. For example, if the surface layer 623 on the leading edge 62*c* is abraded and the elastic blade 622 directly contacts the photoreceptor 3. The leading edge 62*c* may also curl up and a position on the leading surface 62*a* which is several micro-centimeters away from the leading edge 62*c* may directly contacts the photoreceptor 3. This contact may result in a local abrasion of the leading surface 62*a*. To prevent such a local abrasion of the leading surface 62*a*, it is effective to provide the surface layer 623 so as to cover positions on the leading surface 62*a* extending several micro-centimeters away from the leading edge 62*c*.

In another case, if the photoreceptor 3 and/or the cleaning blade 62 are misaligned, the contact pressure of the cleaning blade 62 with the photoreceptor 3 may excessively increase and the cleaning blade 62 may excessively bend. As a result, a position on the lower surface 62*b* which is several micro-centimeters away from the leading edge 62*c* may contact the photoreceptor 3, resulting in a local abrasion of the lower surface 62*b*. Similarly, to prevent such a local abrasion of the lower surface 62*b*, it is effective to provide the surface layer 623 so as to cover positions on the lower surface 62*b* that extend several micro-centimeters away from the leading edge 62*c*.

The surface layer 623 preferably has a thickness of from 1 to 50 μm at a position 50 μm away from the leading edge 62*c*. When the thickness there is too small, the surface layer 623 may have poor stiffness and the leading edge 62*c* may easily curl up. When the thickness there is too large, toner particles may easily pass by the cleaning blade 62. As the surface layer 623 may be formed by spray coating or dip coating, specifically by adhering liquid materials, it is hard to form the surface layer 623 on the leading edge 62*c* due to surface tension. Accordingly, the thickness of the surface layer 623 increases with distance from the leading edge 62*c*. In a case in which the surface layer 623 has a thickness of 50 μm or more at a position 50 μm away from the leading edge 62*c*, the leading edge 62*c* may be obtuse. In this case, referring to FIG. 5, a space X formed on an upstream side from the contact point of the leading surface 62*a* with the photoreceptor 3 becomes narrower when compared to a case in which the leading edge 62*c* is right-angled. When toner particles accumulate in such a narrow space X, the toner particles may be gradually pushed out to the downstream side, resulting in insufficient cleaning of the photoreceptor 3.

Moreover, when the thickness of the surface layer 623 at a position 50 μm away from the leading edge 62*c* is too large, the cleaning blade may be so stiff that noise may occur, abrasion resistance may deteriorate, and the cleaning blade may not sufficiently follow the surface of the photoreceptor 3.

The surface layer 623 may be abraded with time and the leading edge 62*c* of the elastic blade 622 may be exposed to a direct contact with a surface of the photoreceptor 3. As described above, it is not preferable to form the surface layer 623 on the leading edge 62*c* by spray coating or dip coating, specifically by adhering liquid materials, due to surface tension. Accordingly, the surface layer 623 formed on the leading edge 62*c* is thinner than those formed on other parts, and therefore the leading edge 62*c* is exposed at an earlier stage.

When the leading edge 62*c* of the elastic blade 622 is not subjected to any friction-coefficient-lowering treatment, the exposed portion may maintain a high friction coefficient. Therefore, the exposed portion may be stretched in a direction of movement of the photoreceptor 3 due to a large friction force between the photoreceptor 3. Because of having a very small area, the exposed portion may deform slightly, i.e., may micro-vibrate. As a result, noise may occur. In some cases, the exposed portion may curl up and stress may generate in a boundary between the exposed portion of the elastic blade 622 and the surface layer 623. Eventually, the exposed portion may chip away.

Accordingly, the leading edge 62*c* of the elastic blade 622 is preferably subjected to a friction-coefficient-lowering treatment which impregnates at least one compound selected from isocyanate compounds, fluorine compounds, and silicone compounds by spray coating, dip coating, or the like, so that the friction coefficient becomes 0.5 or less. A friction force between the leading edge 62*c* and the photoreceptor 3 is reduced by this treatment, and therefore an exposed portion of the leading edge 62*c* is prevented from deforming in a direction of movement of the photoreceptor 3. As a result, the occurrence of noise, curling up, and chipping away of the exposed portion may be prevented. Further, the exposed portion may not be abraded by the photoreceptor 3 because the friction coefficient is 0.5 or less.

When the surface layer 623 is mostly abraded and most part of the leading edge 62*c* is exposed, the leading edge 62*c* tends to deform in a direction of movement of the photoreceptor 3 and curl up because the elastic blade 622 is flexible. By setting the friction coefficient of the leading edge 62*c* relatively low, the leading edge 62*c* of the elastic blade 622 can be prevented from deforming in a direction of movement of the photoreceptor 3. Furthermore, the surface layer 623 formed on a downstream side from the leading edge 62*c* relative to a direction of movement of the photoreceptor 3, which is stiff and has not been abraded and chipped away, prevents the leading edge 62*c* from deforming in a direction of movement of the photoreceptor 3. Advantageously, the leading edge 62*c* is prevented from curling up by a synergistic effect of the low friction coefficient of 0.5 or less and the stiff surface layer 623 on the downstream side, resulting in prevention of local abrasion of the leading surface 62*a*.

Suitable friction-coefficient-lowering treatments are not limited to the above-described methods.

Generally, as repulsive elastic modulus of the leading edge of a cleaning blade increases, cleaning ability of the cleaning blade increases. This increase occurs because the leading edge more easily micro-vibrates with the increase of repulsive elastic modulus, so that the cleaning edge more strongly bounces toner particles. It is known that cleaning blades using rubber materials having a large repulsive elastic modulus have lower abrasion resistance. By forming a rigid surface layer on the leading edge of a cleaning blade, the cleaning blade can be advantageously prevented from being abraded even when the cleaning blade uses rubber materials having a large repulsive elastic modulus. When the repulsive elastic modulus of the rubber material is too large, the leading edge of the cleaning blade may micro-vibrate with a large amplitude, resulting in noise. The repulsive elastic modulus of a rubber material has a correlation with a temperature (hereinafter "tan Δ peak temperature") at which tan Δ, which represents a viscoelasticity, has a peak. The higher the tan Δ peak temperature, the lower the repulsive elastic modulus, and vice versa.

In the present embodiment, referring to FIG. 5, the cleaning blade 62 which is an elastic blade made of a rubber material having a tan Δ peak temperature of −6° C. or more has a reformed portion 62*d* adjacent to the leading edge 62*c*. The tan Δ peak temperature of the reformed portion 62*d* is from 3 to 7° C. lower than that of unreformed portions, thereby preventing the occurrence of noise without deteriorating cleaning ability of the cleaning blade.

The following verification experiments were performed by varying materials used for the elastic blade 622, impregnants which are to be impregnated to the leading edge of the elastic blade 622, and materials used for the surface layer 623.

Urethane rubbers Nos. 1 to 7 having the following properties at 25° C. were prepared as the elastic blade 622.

| Urethane Rubber No. | Hardness (degree) | Repulsive Elastic Modulus (%) | Manufacturer |
|---|---|---|---|
| 1 | 70 | 50 | Toyo Tire & Rubber Co., Ltd. |
| 2 | 72 | 31 | Toyo Tire & Rubber Co., Ltd. |
| 3 | 71 | 18 | Toyo Tire & Rubber Co., Ltd. |
| 4 | 77 | 27 | Synztec Co., Ltd. |
| 5 | 70 | 68 | Synztec Co., Ltd. |
| 6 | 75 | 50 | Toyo Tire & Rubber Co., Ltd. |
| 7 | 77 | 17 | Synztec Co., Ltd. |

The hardness was measured as according to JIS K6253 using a durometer from Shimadzu Corporation. A measurement specimen was prepared by superimposing multiple sheets of a urethane rubber each having a thickness of about 2 mm so that the resultant specimen has a thickness of 6 mm or more.

The repulsive elastic modulus was measured as according to JIS K6255 using No. 221 RESILLIENCE TESTER from Toyo Seiki Seisaku-Sho, Ltd. A measurement specimen was prepared by superimposing multiple sheets of a urethane rubber each having a thickness of about 2 mm so that the resultant specimen has a thickness of 4 mm or more.

Impregnants Nos. 1 to 10 having the following compositions were prepared.

| Impregnant No. | Composition |
|---|---|
| 1 | Isocyanate compound (MILLIONATE ® MT from Nippon Polyurethane Industry Co., Ltd.): 5 parts<br>2-butanone: 95 parts |
| 2 | Isocyanate compound (MR-100 from Nippon Polyurethane Industry Co., Ltd.): 5 parts<br>Fluorocarbon resin (MODIPER ® F-600 from NOF Corporation): 2 parts<br>2-butanone: 88 parts |
| 3 | Isocyanate compound (CORONATE ® L from Nippon Polyurethane Industry Co., Ltd.): 10 parts<br>Silicone resin (MODIPER ® FS-700 from NOF Corporation): 2 parts<br>2-butanone: 88 parts |
| 4 | Isocyanate compound (MILLIONATE ® MT from Nippon Polyurethane Industry Co., Ltd.): 5 parts<br>Fluorocarbon resin (MODIPER ® F-600 from NOF Corporation): 1 part<br>Silicone resin (MODIPER ® FS-700 from NOF Corporation): 1 part<br>2-butanone: 93 parts |
| 5 | Silicone resin (MODIPER ® FS-700 from NOF Corporation): 10 parts<br>2-butanone: 90 parts |
| 6 | Isocyanate compound (MILLIONATE ® MT from Nippon Polyurethane Industry Co., Ltd.): 5 parts<br>Acrylic silicone resin (COPOLYMER A1 from Chisso Corporation): 2 parts<br>2-butanone: 93 parts |
| 7 | Isocyanate compound (MR-100 from Nippon Polyurethane Industry Co., Ltd.): 10 parts<br>2-butanone: 90 parts |
| 8 | Isocyanate compound (D-177N from Mitsui Chemicals, Inc.): 10 parts<br>2-butanone: 90 parts |
| 9 | Isocyanate compound (MR-100 from Nippon Polyurethane Industry Co., Ltd.): 10 parts<br>Silicone resin (MODIPER ® FS-700 from NOF Corporation): 10 parts<br>2-butanone: 80 parts |
| 10 | Fluorocarbon resin (MODIPER ® F-600 from NOF Corporation): 10 parts<br>2-butanone: 90 parts |

Surface layers Nos. 1 to 7 had the following compositions.

| Surface Layer No. | Composition |
|---|---|
| 1 | Urethane acrylate monomer (UN-904 from Negami Chemical Industrial Co., Ltd.): 20 parts<br>Polymerization initiator (IRGACURE ® 184 from Ciba Specialty Chemicals): 1 part<br>Solvent (2-butanone): 79 parts<br>Molecular weight per functional group of monomer: 490 |
| 2 | Urethane acrylate monomer (UN-904 from Negami Chemical Industrial Co., Ltd.): 20 parts<br>Polymerization initiator (IRGACURE ® 184 from Ciba Specialty Chemicals): 1 part<br>Low-friction-coefficient additive (DEFENSA Exp. TF-3026 from DIC Corporation): 0.5 parts<br>Solvent (2-butanone): 78.5 parts<br>Molecular weight per functional group of monomer: 490 |

-continued

| Surface Layer No. | Composition |
|---|---|
| 3 | Urethane acrylate oligomer 1 (UN-904 from Negami Chemical Industrial Co., Ltd.): 10 parts<br>Urethane acrylate oligomer 2 (UN-2700 from Negami Chemical Industrial Co., Ltd.): 10 parts<br>Polymerization initiator (IRGACURE ® 184 from Ciba Specialty Chemicals): 1 part<br>Solvent (2-butanone): 79 parts<br>Molecular weight per functional group of monomer: 745 |
| 4 | Urethane acrylate oligomer 1 (UN-904 from Negami Chemical Industrial Co., Ltd.): 2 parts<br>Urethane acrylate oligomer 2 (UN-2700 from Negami Chemical Industrial Co., Ltd.): 18 parts<br>Polymerization initiator (IRGACURE ® 184 from Ciba Specialty Chemicals): 1 part<br>Low-friction-coefficient additive (MODIPER ® FS-700 from NOF Corporation): 1 part<br>Solvent (2-butanone): 78 parts<br>Molecular weight per functional group of monomer: 949 |
| 5 | Urethane acrylate oligomer 1 (UN-904 from Negami Chemical Industrial Co., Ltd.): 2 parts<br>Urethane acrylate oligomer 2 (UN-2600 from Negami Chemical Industrial Co., Ltd.): 18 parts<br>Polymerization initiator (IRGACURE ® 184 from Ciba Specialty Chemicals): 1 part<br>Low-friction-coefficient additive (COPOLYMER A1 from Chisso Corporation): 2 parts<br>Solvent (2-butanone): 77 parts<br>Molecular weight per functional group of monomer: 1174 |
| 6 | Urethane acrylate oligomer 1 (UN-904 from Negami Chemical Industrial Co., Ltd.): 2 parts<br>Urethane acrylate oligomer 2 (UN-2700 from Negami Chemical Industrial Co., Ltd.): 18 parts<br>Polymerization initiator (IRGACURE ® 184 from Ciba Specialty Chemicals): 1 part<br>Solvent (2-butanone): 79 parts<br>Molecular weight per functional group of monomer: 949 |
| 7 | Fluorine-based thermosetting resin A (GK-510): 45.5 parts<br>Fluorine-based thermosetting resin B (D-177N): 4.5 parts<br>Solvent (2-butanone): 50 parts |

The low-friction-coefficient additive COPOLYMER A1 in the surface layer No. 5 is a copolymer of the following compounds (a-1) and (a-2) which has a side chain having the acryloyl group (a-3):

(a-1)

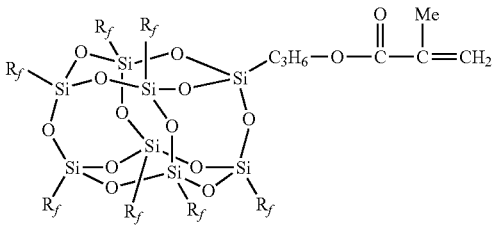

$R_f$: $C_2H_4CF_3$ (a-2)

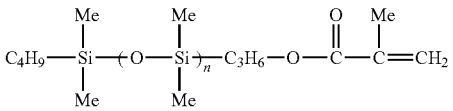

(a-3)

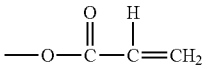

The COPOLYMER A1 has a weight average molecular weight of 37,000 (converted from polystyrene) measured by GPC (Gel Permeation Chromatography) and a molecular weight distribution index (Mw/Mn) of 1.9. The weight ratio (a-1):(a-2) in the COPOLYMER A1 is 1:1.73 measured by $^1$H-NMR.

Each of the urethane rubbers Nos. 1 to 7 was formed into a rectangular-shape elastic blade having a thickness of 2 mm. An end not greater than 5 mm of each of the elastic blades was dipped in any one of the impregnants Nos. 1 to 10 for 10 minutes. The elastic blades thus impregnated with the impregnants were then put in a constant temperature chamber set to 100° C. for 10 minutes so that the urethane rubbers were reacted with isocyanates included in the impregnants. Thus, ends not greater than 5 mm of the elastic blades were reformed. Suitable isocyanates include MDI and HDI because each has a low molecular weight of 500 or less.

Next, an ultraviolet hardening resin was applied to the reformed portion of each of the elastic blades so that any one of the surface layers Nos. 1 to 7 having a thickness of from 1 to 50 μm was formed thereon. Specifically, an ultraviolet hardening resin was applied to either upper/lower or leading surfaces of the elastic blade twice by a spray gun at a movement speed of 10 mm/s, followed by drying for 3 minutes, and was then exposed to an ultraviolet ray of 140 W/cm at 5 m/min for 5 passes. The lower surface was masked with a tape so that a surface layer was formed within 3 mm from an end. Suitable ultraviolet hardening resins include urethane acrylates which form a polymer, in which a cross-linking unit (i.e., a unit between cross-linkages) has a molecular weight of from 300 to 1,500, more preferably 1,000 to 1,500.

Each of the elastic blades that includes a surface layer was fixed to a sheet metal holder by an adhesive to mount the cleaning blades on a full-color image forming apparatus IMAGIO NEO C455 from Ricoh Co., Ltd., which has a similar configuration to the image forming apparatus illustrated in FIG. 2. Each of the cleaning blades was fixed to the image forming apparatus at a linear pressure of 20 g/cm and a cleaning angle of 79°.

A toner produced by a polymerization method which has an average circularity of 0.98 and an average particle diameter of 4.9 μm was used for the experiments. The toner includes 1.5 parts of a small-size silica (H2000 from Clariant), 0.5 parts of a small-size titanium oxide (MT-150AI from Tayca Corporation), and 1.0 part of a large-size silica (UFP-30H from Denki Kagaku Kogyo Kabushiki Kaisha) as external additives.

A running test in which 500,000 sheets of an A4-size horizontal chart having a toner area ratio (%) of 5% are continuously produced with 3 prints/job at 20° C., 65% RH was performed. The toner area ratio is a ratio of an area to which toner particles are adhered to a total image area.

The 500,000$^{th}$ produced image was visually observed to evaluate cleaning ability of the cleaning blade. Further, an abrasion width of the leading edge of the cleaning blade was measured from the lower blade side after each of the 50,000$^{th}$ and 500,000$^{th}$ images was produced.

The thicknesses of the surface layers were measured by observing cross sections thereof using a microscope VHX-100 from Keyence Corporation. The cross sections were prepared using a trimming razor for preparing specimens for SEM from Nisshin EM Corporation.

The friction coefficients of the leading edges of the elastic blades were measured using a friction and wear tester (equipped with a blade holder) from Shinto Scientific Co., Ltd. Specifically, each of the cleaning blades was brought into contact with a pseudo-photoreceptor, in which a coating layer having the same composition as a surface layer is formed on a glass plate, at a linear pressure of 20 g/cm and a cleaning angle of 79° and subjected to a measurement of coefficient of dynamic friction by moving the glass plate.

The tan Δ peak temperatures of the elastic blades were measured as according to old JIS-K7198 as follows.

(1) A urethane rubber was dipped in an impregnant for 10 minutes and drawn up. The urethane rubber was then calcined in an electric furnace at 100° C. for 15 minutes, followed by leaving for a week.

(2) A rectangular specimen with sides of 40 mm×5 mm was cut out from the urethane rubber, and was set to a viscoelasticity measuring device DMS 6100 from Seiko Instruments Inc.

(3) The specimen was then subjected to a measurement of viscoelasticity within a temperature range of from −50 to +80° C. at tension mode, sine wave measurement mode, a heating rate of 3° C./min, and a frequency of 1 Hz. The tan Δ peak temperature was determined from the measurement result.

The results of Examples 1 to 16 and Comparative Examples 1 to 10 are shown in Tables 1-1 to 1-3.

TABLE 1-1

| Examples | Urethane Rubber No. | Impregnant No. | Surface Layer No. | Hardness of Urethane Rubber | Repulsive Elastic Modulus (%) of Urethane Rubber |
|---|---|---|---|---|---|
| Ex. 1 | 2 | 2 | 4 | 72 | 31 |
| Ex. 2 | 3 | 2 | 4 | 71 | 18 |
| Ex. 3 | 4 | 2 | 4 | 77 | 27 |
| Ex. 4 | 4 | 4 | 4 | 77 | 27 |
| Ex. 5 | 3 | 1 | 5 | 71 | 18 |
| Ex. 6 | 3 | 6 | 3 | 71 | 18 |
| Ex. 7 | 3 | 7 | 3 | 71 | 18 |
| Ex. 8 | 3 | 7 | 6 | 71 | 18 |
| Ex. 9 | 3 | 8 | 3 | 71 | 18 |
| Ex. 10 | 3 | 8 | 6 | 71 | 18 |
| Ex. 11 | 3 | 9 | 6 | 71 | 18 |
| Ex. 12 | 3 | 7 | 1 | 71 | 18 |
| Ex. 13 | 3 | 8 | 6 | 71 | 18 |
| Ex. 14 | 3 | 10 | 7 | 71 | 18 |
| Ex. 15 | 7 | 7 | 1 | 77 | 17 |
| Ex. 16 | 7 | 9 | 3 | 77 | 17 |
| Comp. Ex. 1 | 1 | — | — | 70 | 50 |
| Comp. Ex. 2 | 1 | 1 | — | 70 | 50 |
| Comp. Ex. 3 | 1 | — | 1 | 70 | 50 |
| Comp. Ex. 4 | 1 | 1 | 2 | 70 | 50 |
| Comp. Ex. 5 | 1 | 4 | — | 70 | 50 |
| Comp. Ex. 6 | 3 | 7 | — | 71 | 18 |
| Comp. Ex. 7 | 6 | — | 1 | 75 | 50 |
| Comp. Ex. 8 | 1 | 7 | — | 70 | 50 |
| Comp. Ex. 9 | 3 | — | — | 71 | 18 |
| Comp. Ex. 10 | 7 | — | 1 | 77 | 17 |

TABLE 1-2

| Examples | Friction Coefficient of Leading Edge | TanΔ Peak Temp. of Urethane Rubber (° C.) | TanΔ Peak Temp. of Leading Edge (° C.) | Thickness of Surface Layer 50 μm away from Leading Edge (μm) |
|---|---|---|---|---|
| Ex. 1 | 0.15 | −8 | −11 | 5 |
| Ex. 2 | 0.15 | −6 | −9 | 5 |
| Ex. 3 | 0.12 | +1 | −4 | 5 |
| Ex. 4 | 0.1 | +1 | −3 | 5 |
| Ex. 5 | 0.1 | −6 | −11 | 3 |
| Ex. 6 | 0.12 | −6 | −12 | 5 |
| Ex. 7 | 0.3 | −6 | −11 | 10 |
| Ex. 8 | 0.15 | −6 | −11 | 10 |
| Ex. 9 | 0.12 | −6 | −9 | 10 |

TABLE 1-2-continued

| Examples | Friction Coefficient of Leading Edge | TanΔ Peak Temp. of Urethane Rubber (° C.) | TanΔ Peak Temp. of Leading Edge (° C.) | Thickness of Surface Layer 50 μm away from Leading Edge (μm) |
|---|---|---|---|---|
| Ex. 10 | 0.12 | −6 | −9 | 10 |
| Ex. 11 | 0.1 | −6 | −13 | 10 |
| Ex. 12 | 0.15 | −6 | −11 | 10 |
| Ex. 13 | 0.12 | −6 | −11 | 10 |
| Ex. 14 | 0.1 | −6 | −9 | 10 |
| Ex. 15 | 0.1 | +5 | 0 | 10 |
| Ex. 16 | 0.1 | +5 | −1 | 10 |
| Comp. Ex. 1 | 1.2 | −19 | — | — |
| Comp. Ex. 2 | 0.3 | −19 | −20 | — |
| Comp. Ex. 3 | 1.2 | −19 | — | 5 |
| Comp. Ex. 4 | 0.3 | −19 | −20 | 70 |
| Comp. Ex. 5 | 0.1 | −19 | −21 | — |
| Comp. Ex. 6 | 0.3 | −6 | −11 | — |
| Comp. Ex. 7 | 1.2 | −18 | — | 10 |

TABLE 1-2-continued

| Examples | Friction Coefficient of Leading Edge | TanΔ Peak Temp. of Urethane Rubber (° C.) | TanΔ Peak Temp. of Leading Edge (° C.) | Thickness of Surface Layer 50 μm away from Leading Edge (μm) |
|---|---|---|---|---|
| Comp. Ex. 8 | 0.2 | −19 | −20 | — |
| Comp. Ex. 9 | 1.2 | −6 | — | — |
| Comp. Ex. 10 | 1.2 | −18 | — | 10 |

TABLE 1-3

| Examples | Abrasion Width after 50,000th image (μm) | Abrasion Width after 500,000th image (μm) | Degree of Cleaning | Unpleasant Noise | Remarks |
|---|---|---|---|---|---|
| Ex. 1 | 10 | 75 | Good | No | |
| Ex. 2 | 10 | 75 | Good | No | |
| Ex. 3 | 10 | 50 | Good | No | |
| Ex. 4 | 15 | 50 | Good | No | |
| Ex. 5 | 10 | 75 | Good | No | |
| Ex. 6 | 10 | 75 | Good | No | |
| Ex. 7 | 10 | 100 | Good | No | |
| Ex. 8 | 10 | 75 | Good | No | |
| Ex. 9 | 15 | 100 | Good | No | |
| Ex. 10 | 10 | 100 | Good | No | |
| Ex. 11 | 10 | 50 | Good | No | |
| Ex. 12 | 15 | 100 | Good | No | |
| Ex. 13 | 10 | 50 | Good | No | |
| Ex. 14 | 15 | 100 | Good | No | |
| Ex. 15 | 10 | 50 | Good | No | |
| Ex. 16 | 10 | 75 | Good | No | |
| Comp. Ex. 1 | 20 | 400 | Band-shape deposition × 2 | No | Leading edge is abraded and hollowed |
| Comp. Ex. 2 | 50 | 300 | Stripe-shape deposition × 2 | No | Leading edge is abraded and hollowed |
| Comp. Ex. 3 | 50 | 250 | Band-shape deposition × 2 | Yes | |
| Comp. Ex. 4 | 150 | 500 | Band-shape deposition × 5 | Yes | |
| Comp. Ex. 5 | 50 | 300 | Stripe-shape deposition × 3 | No | Leading edge is abraded and hollowed |
| Comp. Ex. 6 | 15 | 300 | Stripe-shape deposition × 2 | No | Leading edge is abraded and hollowed |
| Comp. Ex. 7 | 10 | 250 | Band-shape deposition × 2 | Yes | |
| Comp. Ex. 8 | 15 | 400 | Stripe-shape deposition × 2 | No | Leading edge is abraded and hollowed |
| Comp. Ex. 9 | 15 | 300 | Stripe-shape deposition × 2 | No | Leading edge is abraded and hollowed |
| Comp. Ex. 10 | 10 | 250 | Band-shape deposition × 2 | Yes | |

In Comparative Example 3, the leading edge was not reformed to have a lower tan Δ peak temperature. As a result, band-shape depositions were observed and noise was made. Further, the leading edge was partially chipped away. The reason is believed to be that the surface layer of the cleaning blade was abraded with time and the exposed portion of the leading edge was deformed slightly in a direction of movement of the photoreceptor which resulted in micro-vibration, because the exposed portion has a high friction coefficient of 1.2. Since the tan Δ peak temperature of the cleaning blade is low (the cleaning blade has a high repulsive elastic modulus) it is believed that the exposed portion of the leading edge micro-vibrated at a large amplitude, resulting in noise. Further, it is believed that the partial chipping away of the leading edge was caused because the exposed portion of the elastic blade was curled up and chipped away. As a result, band-shape depositions were caused.

In Comparative Examples 2, 5, 6, and 8, the leading edge was reformed to have a low friction coefficient or a low tan Δ peak temperature but had no surface layer. As a result, the leading surface was abraded and hollowed and stripe-shape depositions were caused because the leading edge micro-vibrated at a large amplitude, although no noise was made.

In each of Examples 1 to 16, noise was not made. The surface layer disappeared due to abrasion and the leading edge of the elastic blade was exposed. However, the leading surface was not abraded and hollowed and no band-shape or stripe-shape deposition was caused. This is because the surface layers formed on downstream sides of the exposed portion of the elastic blade relative to a direction of movement of the photoreceptor, prevents the exposed portion of the leading edge of the elastic blade from deforming in a direction of movement of the photoreceptor.

In each of Examples 1 to 16, noise was not made and the leading surface was not abraded and hollowed, advantageously providing good cleaning ability for an extended period of time. Since the elastic blade has been treated with impregnants, abrasion rate of the elastic blade can be reduced, resulting in a comparatively long lifespan of the cleaning blade. The cleaning blades of Examples 1 to 16 have more than twice the lifespan of cleaning blades which have not been treated with impregnants (such as Comparative Examples 1 and 3).

Accordingly, in a case in which only the leading edge (and its vicinity) is reformed to have a low tan Δ peak temperature, in other words, to have a high repulsive elastic modulus, the cleaning blade exhibits both high durability and good cleaning ability.

Such a cleaning blade is not required to change a way of contacting photoreceptor, which contributes to lowering of cost.

In addition to monochrome image forming apparatuses as aforementioned, the cleaning blades previously described may be applied to full-color image forming apparatuses.

Figure 6:
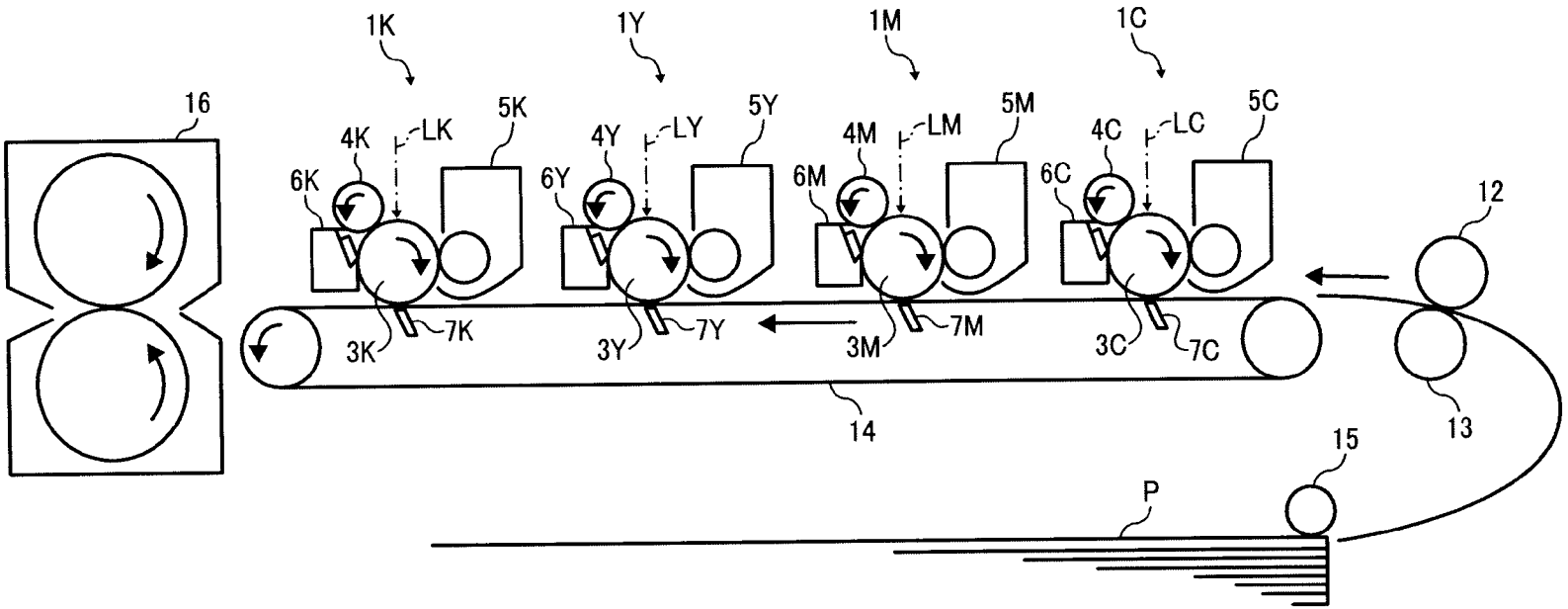
FIG. 6 is a schematic view illustrating an embodiment of a tandem full-color image forming apparatus.

FIG. 6 is a schematic view illustrating an embodiment of a tandem full-color image forming apparatus.

Drum-shaped photoreceptors 3C, 3M, 3Y, and 3K each rotate in directions indicated by arrows in FIG. 6. Around the photoreceptors 3C, 3M, 3Y, and 3K, chargers 4C, 4M, 4Y, and 4K, developing devices 5C, 5M, 5Y, and 5K, and cleaning devices 6C, 6M, 6Y, and 6K are respectively disposed in this order relative to the directions of rotations of the photoreceptors 3C, 3M, 3Y, and 3K.

Laser light beams LC, LM, LY, and LK are directed on the photoreceptors 3C, 3M, 3Y, and 3K, respectively, from between the respective chargers 4C, 4M, 4Y, and 4K and respective developing devices 5C, 5M, 5Y, and 5K so that electrostatic latent images are formed on each photoreceptors 3C, 3M, 3Y, and 3K. Each of the photoreceptors 3C, 3M, 3Y, and 3K, the chargers 4C, 4M, 4Y, and 4K, the developing devices 5C, 5M, 5Y, and 5K, and the cleaning devices 6C, 6M, 6Y, and 6K are formed into process cartridges 1C, 1M, 1Y, and 1K, respectively. The process cartridges 1C, 1M, 1Y, and 1K are disposed along a transfer conveyance belt 14 serving as a member for conveying a transfer medium. The transfer conveyance belt 14 is in contact with the photoreceptors 3C, 3M, 3Y, and 3K at between the developing devices 5C, 5M, 5Y, and 5K and the cleaning devices 6C, 6M, 6Y, and 6K, respectively. Transfer brushes 7C, 7M, 7Y, and 7K are disposed on back surfaces of the transfer conveyance belt 14 so as to face the photoreceptors 3C, 3M, 3Y, and 3K, respectively. The process cartridges 1C, 1M, 1Y, and 1K have the same configuration except that the developing devices 5C, 5M, 5Y, and 5K each contain different-color toners.

An image forming operation of the image forming apparatus illustrated in FIG. 6 is described below. First, the photoreceptors 3C, 3M, 3Y, and 3K are charged by the chargers 4C, 4M, 4Y, and 4K, respectively, each rotating in directions indicated by arrows in FIG. 6 so as to follow rotation of the photoreceptors 3C, 3M, 3Y, and 3K. Subsequently, irradiators, not shown, direct the laser light beams LC, LM, LY, and LK onto the photoreceptors 3C, 3M, 3Y, and 3K, respectively, to form electrostatic latent images thereon.

The developing devices 5C, 5M, 5Y, and 5K develop the electrostatic latent images with cyan, magenta, yellow, and black toners, respectively, to form cyan, magenta, yellow, and black toner images on the photoreceptors 3C, 3M, 3Y, and 3K, respectively. The cyan, magenta, yellow, and black toner images are superimposed on one another on a transfer paper P.

The transfer paper P is fed from a tray by a paper feeding roller 15 and stopped between an upper registration roller 12 and a lower registration roller 13. The transfer paper P is then fed onto the transfer conveyance belt 14 in synchronization with an image formation on the photoreceptors 3C, 3M, 3Y, and 3K. The transfer conveyance belt 14 conveys the transfer paper P so that the cyan, magenta, yellow, and black toner images are transferred onto the transfer paper P at contact points of the transfer conveyance belt 14 with the photoreceptors 3C, 3M, 3Y, and 3K (i.e., transfer areas), respectively.

The cyan, magenta, yellow, and black toner images are transferred onto the transfer paper P by electric fields formed between the photoreceptors 3C, 3M, 3Y, and 3K and the transfer brushes 7C, 7M, 7Y, and 7K to which transfer biases are applied, respectively. The transfer paper P on which the cyan, magenta, yellow, and black toner images are superimposed is then fed to a fixing device 16 so that the toner images are fixed on the transfer paper P, and discharged from the image forming apparatus to a discharge part, not shown. Residual toner particles remaining on the photoreceptors 3C, 3M, 3Y, and 3K are collected by the cleaning devices 6C, 6M, 6Y, and 6K. In FIG. 6, image forming units are arranged in the order of cyan, magenta, yellow, and black relative to a direction of conveyance of transfer paper, however, the arrangement order of color is not limited thereto.

In FIG. 6, the chargers 4C, 4M, 4Y, and 4K are in contact with the respective photoreceptors 3C, 3M, 3Y, and 3K. Alternatively, an appropriate gap of from 10 to 200 μm may be formed between the chargers 4C, 4M, 4Y, and 4K and the respective photoreceptors 3C, 3M, 3Y, and 3K so as to prevent abrasion thereof and formation of undesirable toner films thereon.

The process cartridges 1C, 1M, 1Y, and 1K contain the cleaning devices 6C, 6M, 6Y, and 6K, respectively, each containing a cleaning blade including an elastic blade. An end of each respective cleaning blade has been subjected to a friction-coefficient-lowering treatment so as to have a friction coefficient of 0.5 or less. The cleaning blades include a surface layer which covers the end, having a thickness of from 1 to 50 μm, and is made of a ultraviolet hardening resin which is harder than the elastic blade.

The exemplary cleaning blade described above employed in the full-color image forming apparatus of the present embodiment may reliably and constantly provide good cleaning ability without causing curling up of the leading edge of the cleaning blade even when the linear pressure of the cleaning blade to the photoreceptor is increased for the purpose of removing polymerization toners.

Further, even when the leading edge of the elastic blade exposes with time, micro-vibration is less likely to occur.

Alternatively, the cleaning devices 6C, 6M, 6Y, and 6K may respectively contain a cleaning blade including a rectangular-shape elastic blade made of a rubber material. An end of the blade is preferably not greater than 5 mm and has been reformed to have a tan Δ peak temperature of from 3 to 7° C. lower than that of a portion which has not been reformed. The cleaning blade also preferably includes a surface layer which covers the end and is harder than the elastic blade.

The above-described full-color image forming apparatuses may reliably and constantly provide good cleaning ability for an extended period of time without causing curling up of the leading edge of the cleaning blade and noise.

A second example embodiment of the present invention is described below. The electrophotographic printer illustrated in FIG. 2 is applicable to the second example embodiment.

The following verification experiments were performed by varying materials used for the elastic blade 622, impregnants which are impregnated to the leading edge of the elastic blade 622, and materials used for the surface layer 623.

Urethane rubbers Nos. 8 to 11 having the following properties at 25° C. were prepared as the elastic blade 622.

| Urethane Rubber No. | Hardness (degree) | Repulsive Elastic Modulus (%) | Manufacturer |
|---|---|---|---|
| 8 | 70 | 50 | Toyo Tire & Rubber Co., Ltd. |
| 9 | 71 | 18 | Toyo Tire & Rubber Co., Ltd. |
| 10 | 75 | 50 | Toyo Tire & Rubber Co., Ltd. |
| 11 | 77 | 17 | Synztec Co., Ltd. |

The hardness was measured as according to JIS K6253 using a durometer from Shimadzu Corporation. A measurement specimen was prepared by superimposing multiple sheets of a urethane rubber each having a thickness of about 2 mm so that the resultant specimen has a thickness of 6 mm or more.

The repulsive elastic modulus was measured as according to JIS K6255 using No. 221 RESILLIENCE TESTER from Toyo Seiki Seisaku-Sho, Ltd. A measurement specimen was prepared by superimposing multiple sheets of a urethane rubber each having a thickness of about 2 mm so that the resultant specimen has a thickness of 4 mm or more.

Impregnants Nos. 11 to 14 having the following compositions were prepared.

| Impregnant No. | Composition |
|---|---|
| 11 | Isocyanate compound (MR-100 from Nippon Polyurethane Industry Co., Ltd.): 10 parts<br>2-butanone: 90 parts |
| 12 | Isocyanate compound (D-177N from Mitsui Chemicals, Inc.): 10 parts<br>2-butanone: 90 parts |
| 13 | Isocyanate compound (MR-100 from Nippon Polyurethane Industry Co., Ltd.): 10 parts<br>Silicone resin (MODIPER ® FS-700 from NOF Corporation): 10 parts<br>2-butanone: 80 parts |
| 14 | Fluorocarbon resin (MODIPER ® F-600 from NOF Corporation): 10 parts<br>2-butanone: 90 parts |

Surface layers Nos. 8 to 11 had the following compositions.

| Surface Layer No. | Composition |
|---|---|
| 8 | Ultraviolet hardening resin (UN-904 from Negami Chemical Industrial Co., Ltd.): 20 parts<br>Polymerization initiator (IRGACURE ® 184 from Ciba Specialty Chemicals): 1 part<br>Solvent (2-butanone): 79 parts<br>Molecular weight per cross-linking unit: 980 |
| 9 | Ultraviolet hardening resin 1 (UN-904 from Negami Chemical Industrial Co., Ltd.): 10 parts<br>Ultraviolet hardening resin 2 (UN-2700 from Negami Chemical Industrial Co., Ltd.): 10 parts<br>Polymerization initiator (IRGACURE ® 184 from Ciba Specialty Chemicals): 1 part<br>Solvent (2-butanone): 79 parts<br>Molecular weight per cross-linking unit: 1490 |

-continued

| Surface Layer No. | Composition |
|---|---|
| 10 | Ultraviolet hardening resin 1 (UN-904 from Negami Chemical Industrial Co., Ltd.): 2 parts<br>Ultraviolet hardening resin 2 (UN-2700 from Negami Chemical Industrial Co., Ltd.): 18 parts<br>Polymerization initiator (IRGACURE ® 184 from Ciba Specialty Chemicals): 1 part<br>Solvent (2-butanone): 79 parts<br>Molecular weight per cross-linking unit: 1900 |
| 11 | Fluorine-based thermosetting resin A (GK-510): 45.5 parts<br>Fluorine-based thermosetting resin B (D-177N): 4.5 parts<br>Solvent (2-butanone): 50 parts |

Each of the urethane rubbers Nos. 8 to 11 was formed into a rectangular-shape elastic blade having a thickness of 2 mm. An end, not greater than 5 mm, of each of the elastic blades was dipped in one of the impregnants Nos. 11 to 14 for 10 minutes. The elastic blades thus impregnated with the impregnants were then put in a constant temperature chamber set to 100° C. for 10 minutes so that the urethane rubbers were reacted with isocyanates included in the impregnants. Thus, the ends not greater than 5 mm of the elastic blades were reformed. Suitable isocyanates preferably include MDI and HDI because each has a low molecular weight of 500 or less.

Next, an ultraviolet hardening resin was applied to the reformed portion of each of the elastic blades so that the surface layers Nos. 8 to 11 having a thickness of 10 μm were formed thereon. Specifically, an ultraviolet hardening resin was applied to either upper/lower or leading surfaces of the elastic blade twice by a spray gun at a movement speed of 10 mm/s, followed by drying for 3 minutes, and was then exposed to an ultraviolet ray of 140 W/cm at 5 m/min for 5 passes. The lower surface was masked with a tape so that a surface layer was formed within 3 mm from an end. Suitable ultraviolet hardening resins include urethane acrylates which form a polymer, in which a cross-linking unit (i.e., a unit between cross-linkages) has a molecular weight of from 300 to 1,500, more preferably 1,000 to 1,500.

Each of the elastic blades that includes a surface layer was fixed to a sheet metal holder by an adhesive to mount the cleaning blades on a full-color image forming apparatus IMAGIO NEO C455 from Ricoh Co., Ltd., which has a similar configuration to the image forming apparatus illustrated in FIG. 2. Each of the cleaning blades was fixed to the image forming apparatus at a linear pressure of 20 g/cm and a cleaning angle of 79°.

A toner produced by a polymerization method which has an average circularity of 0.98 and an average particle diameter of 4.9 μm was used for the experiments. The toner includes 1.5 parts of a small-size silica (H2000 from Clariant), 0.5 parts of a small-size titanium oxide (MT-150AI from Tayca Corporation), and 1.0 part of a large-size silica (UFP-30H from Denki Kagaku Kogyo Kabushiki Kaisha) as external additives.

A running test in which 500,000 sheets of an A4-size horizontal chart having a toner area ratio (%) of 5% are continuously produced with 3 prints/job at 20° C., 65% RH was performed. The toner area ratio is a ratio of an area to which toner particles are adhered to a total image area.

The 500,000$^{th}$ produced image was visually observed to evaluate cleaning ability of the cleaning blade. Further, an abrasion area of the leading edge of the cleaning blade was measured from the lower blade side after the 500,000$^{th}$ image was produced.

The thicknesses of the surface layers were measured by observing cross sections thereof using a microscope VHX-100 from Keyence Corporation. The cross sections were prepared using a trimming razor for preparing specimens for SEM from Nisshin EM Corporation.

The tan Δ peak temperatures of the elastic blades were measured as according to old JIS-K7198 as previously described.

The results of Examples 17 to 21 and Comparative Examples 11 to 13 are shown in Tables 2-1 to 2-3.

TABLE 2-1

| Examples | Urethane Rubber No. | Impregnant No. | Surface Layer No. |
|---|---|---|---|
| Ex. 17 | 9 | 11 | 8 |
| Ex. 18 | 9 | 12 | 10 |
| Ex. 19 | 10 | 14 | 11 |
| Ex. 20 | 11 | 11 | 8 |
| Ex. 21 | 11 | 13 | 9 |
| Comp. Ex. 11 | 8 | 11 | — |
| Comp. Ex. 12 | 9 | — | — |
| Comp. Ex. 13 | 10 | — | 8 |

TABLE 2-2

| Examples | TanΔ Peak Temp. of Urethane Rubber (° C.) | TanΔ Peak Temp. of Reformed End (° C.) | TanΔ Peak Temp. of Surface Layer (° C.) | Thickness of Surface Layer 50 μm away from Leading Edge (μm) |
|---|---|---|---|---|
| Ex. 17 | −6 | −11 | 60 | 10 |
| Ex. 18 | −6 | −11 | 50 | 10 |
| Ex. 19 | −6 | −9 | 50 | 10 |
| Ex. 20 | +5 | +1 | 60 | 10 |
| Ex. 21 | +5 | −2 | 45 | 10 |
| Comp. Ex. 11 | −19 | −20 | — | — |
| Comp. Ex. 12 | −6 | — | — | — |
| Comp. Ex. 13 | −18 | — | 60 | 10 |

TABLE 2-3

| Examples | Abrasion Width after 500,000$^{th}$ image (μm) | Degree of Cleaning | Unpleasant Noise | Abrasion and Hollow of Leading edge |
|---|---|---|---|---|
| Ex. 17 | 100 | Good | No | No |
| Ex. 18 | 50 | Good | No | No |
| Ex. 19 | 100 | Good | No | No |
| Ex. 20 | 50 | Good | No | No |
| Ex. 21 | 75 | Good | No | No |
| Comp. Ex. 11 | 400 | Band-shape deposition × 2 | No | Yes |
| Comp. Ex. 12 | 300 | Stripe-shape deposition × 2 | No | Yes |
| Comp. Ex. 13 | 250 | Band-shape deposition × 2 | Yes | No |

In Comparative Example 13, the leading edge was not reformed to have a lower tan Δ peak temperature. As a result, band-shape depositions were observed and noise was made. Further, the leading edge was partially chipped away. The reason is believed to be that since the tan Δ peak temperature of the cleaning blade is low, in other words, the cleaning blade has a high repulsive elastic modulus, the exposed portion of the leading edge micro-vibrated at too large an amplitude, resulting in noise. Further, it is believed that the partial chipping away of the leading edge was caused because the exposed portion of the elastic blade was curled up and chipped away. As a result, band-shape depositions were caused.

In Comparative Example 11, the leading edge was reformed to have a low tan Δ peak temperature but had no surface layer. As a result, the leading surface was abraded and hollowed and stripe-shape depositions were caused because the leading edge micro-vibrated at a large amplitude, although no noise was made.

In each of Examples 17 to 21, noise was not made. The surface layer disappeared due to abrasion and the leading edge of the elastic blade was exposed. However, the leading surface was not abraded and hollowed and no band-shape or stripe-shape deposition was caused. This is because the surface layers formed on downstream sides of the exposed portion of the elastic blade relative to a direction of movement of the photoreceptor, prevents the exposed portion of the leading edge of the elastic blade from deforming in a direction of movement of the photoreceptor.

In each of Examples 17 to 21, noise was not made and the leading surface was not abraded and hollowed, advantageously providing good cleaning ability for an extended period of time.

Accordingly, in a case in which only the leading edge (and its vicinity) is reformed to have a low tan Δ peak temperature, in other words, to have a high repulsive elastic modulus, the cleaning blade exhibits both high durability and good cleaning ability simultaneously. Since the elastic blade has been treated with impregnants, abrasion rate of the elastic blade can be reduced, resulting in a comparatively long lifespan of the cleaning blade. The cleaning blades of Examples 17 to 21 have more than twice the lifespan of cleaning blades which have not been treated with impregnants (such as Comparative Examples 12 and 13).

When the surface layer has a tan Δ peak temperature 40° C. or more higher than that of non-reformed portions of the elastic blade, the leading edge of the elastic blade can be prevented from curling up.

Such a cleaning blade is not required to change a way of contacting the photoreceptor, which contributes to lowering of cost.

In addition to monochrome image forming apparatuses as aforementioned, the cleaning blades of the present invention may be applied to full-color image forming apparatuses as illustrated in FIG. 6.

In the present embodiment, the cleaning devices 6C, 6M, 6Y, and 6K respectively contained in the process cartridges 1C, 1M, 1Y, and 1K each contains a cleaning blade including a rectangular-shape elastic blade made of a rubber material. An end not larger than 5 mm of each respective cleaning blade is preferably reformed to have a tan Δ peak temperature of from 3 to 7° C. lower than that of a portion which has not been reformed. The cleaning blades include a surface layer which covers the end, which is harder than the elastic blade, and has a tan Δ peak temperature of 40° C. or more higher than that of a non-reformed portion of the elastic blade.

Because of employing the cleaning blade as described above, the full-color image forming apparatus of the present embodiment may reliably and constantly provide good cleaning ability without causing curling up of the leading edge of the cleaning blade even when the linear pressure of the cleaning blade to the photoreceptor is increased for the purpose of removing polymerization toners.

According to the example embodiments, the cleaning blade 62 is configured to remove toner particles (powders)

from the photoreceptor 3, that serves as a cleaning target, via contact with the photoreceptor 3. The cleaning blade 62 includes the elastic blade 622 which has been subjected to a friction-coefficient-lowering treatment so that the leading edge 62*c* has a friction coefficient of 0.5 or less. The cleaning blade also includes the surface layer 623 that covers the leading edge 62*c* of the elastic blade 622, having a thickness of from 1 to 50 μm and is harder than the elastic blade 622. Such a configuration prevents the surface layer 623 from being abraded and the leading edge 62*c* from curling up. Accordingly, the cleaning blade 62 is capable of providing good cleaning ability reliably and constantly.

According to the example embodiments, when the leading edge is not greater than 5 mm and/or its vicinity are/is reformed to have a tan Δ peak temperature of from 3 to 7° C. lower than that of a portion which has not been reformed, good cleaning ability may be reliably and constantly provided without causing noise.

According to the second example embodiment, when the tan Δ peak temperature (t2) of the surface layer 623 is 40° C. or more higher than the tan Δ peak temperature (t1) of a non-reformed potion of the elastic blade 622, i.e., t2≧t1+40 is satisfied, the leading edge 62*c* of the elastic blade 622 can be prevented from curling up.

According to the example embodiments, when rubber materials used for the elastic blade 622 has a JIS-A hardness of from 65° to 80° and a repulsive elastic modulus of 80% or less and includes urethane group, the cleaning blade 62 advantageously deforms following eccentricity of the photoreceptor 3. Accordingly, the cleaning blade 62 can keep a predetermined contact pressure constantly, providing good cleaning ability.

According to the example embodiments, the surface layer 623 can be preferably formed on the leading edge 62C of the elastic blade 622 using ultraviolet hardening resin, a thermosetting resin, or a fluorine-based thermosetting resin.

According to the example embodiments, the surface layer 623 formed using an ultraviolet hardening resin formed for example from a raw material monomer, a cross-linking unit of which has a number average molecular weight of from 300 to 1,500. In this case, the leading edge 62*c* is prevented from curling up but capable of deforming in a direction of movement of the photoreceptor. As a result, noise is not made and abrasion resistance of the surface layer 623 is improved.

According to the example embodiments, the leading edge 62*c* of the elastic blade 622 is impregnated within an impregnant selected for example from an isocyanate compound, a fluorine compound, and a silicone compound. Furthermore, the leading edge 62*c* has a friction coefficient of 0.5 or less.

According to the example embodiments, suitable isocyanate compounds preferably have a number average molecular weight of 500 or less.

According to the example embodiments, an image forming apparatus containing the cleaning blade 62 to remove residual toner particles remaining on the photoreceptor 3 is capable of providing high-grade images for an extended period of time.

According to the example embodiments, the process cartridge 1 containing the cleaning blade 62 is capable of providing good cleaning ability.

Having now fully described the invention, it will be apparent to one of ordinary skill in the art that many changes and modifications can be made thereto without departing from the spirit and scope of the invention as set forth therein.

Numerous additional modifications and variations are possible in light of the above teachings. It is therefore to be understood that the disclosure of this patent specification may be practiced otherwise than as specifically described herein.

What is claimed is:

1. A cleaning blade configured to remove fine particles from a cleaning target by contact with the cleaning target, comprising:

an elastic blade, a leading edge of the elastic blade including a friction coefficient of 0.5 or less; and a surface layer that covers the leading edge of the elastic blade, wherein a thickness of the surface layer at a position 50 μm away from the leading edge is between 1 and 50 μm, and wherein a hardness of the surface layer is greater than a hardness of the elastic blade, wherein a position 5 mm or less away from the leading edge of the elastic blade includes a tan Δ peak temperature that is 3 to 7° C. lower than a tan Δ peak temperature of a position greater than 5 mm away from the leading edge of the elastic blade, and wherein the following equation is satisfied:

$$t2 \geqq t1+40$$

wherein t1 (° C.) represents the tan Δ peak temperature of the position greater than 5 mm away from the leading edge of the elastic blade and t2 (° C.) represents a tan Δ peak temperature of the surface layer.

2. The cleaning blade according to claim 1, wherein the elastic blade includes a rubber material including a urethane group, and wherein a JIS-A hardness of the elastic blade is between 65° to 80°, and wherein a repulsive elastic modulus of the elastic blade is 80% or less.

3. The cleaning blade according to claim 1, wherein the surface layer includes at least one of an ultraviolet hardening resin, a thermosetting resin, and a fluorine-based thermosetting resin.

4. The cleaning blade according to claim 3, wherein the surface layer includes an ultraviolet hardening resin, a cross-linking unit of the ultraviolet hardening resin including a number average molecular weight of from 300 to 1,500.

5. The cleaning blade according to claim 1, wherein the leading edge of the elastic blade is impregnated with at least one of an isocyanate compound, a fluorine compound, and a silicone compound.

6. The cleaning blade according to claim 5, wherein the leading edge of the elastic blade is impregnated with an isocyanate compound having a number average molecular weight of 500 or less.

7. An image forming apparatus, comprising:

an image bearing member;

a charger configured to charge a surface of the image bearing member;

a latent image forming device configured to form a latent image on the charged surface of the image bearing member;

a developing device configured to develop the latent image on the surface of the image bearing member to form a toner image;

a transfer device configured to transfer the toner image from the surface of the image bearing member onto a transfer member; and a cleaning device including a cleaning blade configured to remove residual toner particles that remain on the surface of the image bearing member by contact with the surface of the image bearing member, wherein the cleaning blade is the cleaning blade according to claim 1.

8. A process cartridge detachably provided to an image forming apparatus, comprising:

an image bearing member; and a cleaning device including a cleaning blade configured to remove residual toner particles that adhere to a surface of the image bearing member by contact with the surface of the image bearing member, wherein the cleaning blade is the cleaning blade according to claim 1.

9. An image forming method, comprising:

forming a toner image on an image bearing member;

transferring the toner image from the image bearing member onto a transfer member; and removing residual toner particles that remain on the transfer member using a cleaning blade, wherein the cleaning blade includes an elastic blade, a leading edge of the elastic blade including a friction coefficient of 0.5 or less, and a surface layer that covers the leading edge of the elastic blade, wherein a thickness of the surface layer at a position 50 μm away from the leading edge is between 1 and 50 μm and a hardness of the surface layer is greater than a hardness of the elastic blade, wherein a position 5 mm or less away from the leading edge of the elastic blade includes a tan Δ peak temperature that is 3 to 7° C. lower than a tan Δ peak temperature of a position greater than 5 mm away from the leading edge of the elastic blade, and wherein the following equation is satisfied:

$$t2 \geqq t1+40$$

wherein t1 (° C.) represents the tan Δ peak temperature of the position greater than 5 mm away from the leading edge of the elastic blade and t2 (° C.) represents a tan Δ peak temperature of the surface layer.

10. A cleaning blade configured to remove fine particles from a cleaning target by contact with the cleaning target, comprising:

an elastic blade, a leading edge of the elastic blade including a friction coefficient of 0.5 or less; and means for covering the leading edge of the elastic blade, wherein a thickness of the means for covering at a position 50 μm away from the leading edge is between 1 and 50 μm, wherein a hardness of the means for covering is greater than a hardness of the elastic blade, wherein a position 5 mm or less away from the leading edge of the elastic blade includes a tan Δ peak temperature that is 3 to 7° C. lower than a tan Δ peak temperature of a position greater than 5 mm away from the leading edge of the elastic blade, and wherein the following equation is satisfied:

$$t2 \geqq t1+40$$

wherein t1 (° C.) represents the tan Δ peak temperature of the position greater than 5 mm away from the leading edge of the elastic blade and t2 (° C.) represents a tan Δ peak temperature of the means for covering.

11. The cleaning blade according to claim 10, wherein the elastic blade includes a rubber material including a urethane group, and wherein a JIS-A hardness of the elastic blade is between 65° to 80°, and wherein a repulsive elastic modulus of the elastic blade is 80% or less.

12. The cleaning blade according to claim 10, wherein the means for covering includes at least one of an ultraviolet hardening resin, a thermosetting resin, and a fluorine-based thermosetting resin.

13. The cleaning blade according to claim 12, wherein the means for covering includes an ultraviolet hardening resin, a cross-linking unit of the ultraviolet hardening resin including a number average molecular weight of from 300 to 1,500.

14. The cleaning blade according to claim 10, wherein the leading edge of the elastic blade is impregnated with at least one of an isocyanate compound, a fluorine compound, and a silicone compound.

15. The cleaning blade according to claim 14, wherein the leading edge of the elastic blade is impregnated with an isocyanate compound having a number average molecular weight of 500 or less.

* * * * *